US007753284B1

(12) United States Patent
Raitses

(10) Patent No.: US 7,753,284 B1
(45) Date of Patent: Jul. 13, 2010

(54) BUOYANT STRAW DEVICE

(76) Inventor: Adar Raitses, 1515 Lincoln Ave., Holbrook, NY (US) 11741

( * ) Notice: Subject to any disclaimer, the term of this patent is extended or adjusted under 35 U.S.C. 154(b) by 0 days.

(21) Appl. No.: 12/055,245

(22) Filed: Mar. 25, 2008

(51) Int. Cl.
*A47G 21/18* (2006.01)
*A61J 15/00* (2006.01)

(52) U.S. Cl. ..... 239/33; 239/24; 239/16

(58) Field of Classification Search ..... 239/33; 229/103.1; 215/229, 388, 389; 220/705–710
See application file for complete search history.

(56) References Cited

U.S. PATENT DOCUMENTS

| | | | | |
|---|---|---|---|---|
| 942,306 | A | 12/1909 | Clarke | |
| 1,253,579 | A | 1/1918 | Deanes | |
| 1,309,994 | A | 7/1919 | McAuliffe | |
| 2,072,580 | A | 3/1937 | Correll | |
| 3,099,565 | A | 7/1963 | Neuhauser | |
| 4,109,817 | A | 8/1978 | Payne et al. | |
| 4,733,785 | A | 3/1988 | Turner, Jr. et al. | |
| 4,877,148 | A | 10/1989 | Larson et al. | |
| 5,160,058 | A | 11/1992 | Ahn | |
| D333,586 | S | 3/1993 | Cohen et al. | |
| 5,201,460 | A * | 4/1993 | Caines | 229/103.1 |
| 5,253,779 | A | 10/1993 | Lee | |
| 5,431,297 | A | 7/1995 | Rosello | |
| D372,624 | S | 8/1996 | Chein | |
| 5,547,103 | A | 8/1996 | Murphy et al. | |
| 5,975,340 | A | 11/1999 | Cornell et al. | |
| 6,000,573 | A | 12/1999 | Murphy et al. | |
| 6,006,952 | A | 12/1999 | Lucas | |
| 6,024,012 | A * | 2/2000 | Luzenberg, Jr. | 99/323 |
| 6,142,326 | A | 11/2000 | Cornell et al. | |
| 6,158,611 | A * | 12/2000 | Cornell et al. | 220/706 |
| 6,230,913 | B1 | 5/2001 | Cornell et al. | |
| 6,460,777 | B2 * | 10/2002 | Float et al. | 239/33 |
| 6,945,425 | B1 | 9/2005 | Kim | |

FOREIGN PATENT DOCUMENTS

| | | |
|---|---|---|
| GB | 621455 | 4/1949 |
| WO | WO99/26861 | 6/1999 |

* cited by examiner

*Primary Examiner*—Dinh Q. Nguyen
(74) *Attorney, Agent, or Firm*—Michael I Kroll

(57) ABSTRACT

A drinking straw having bladders of air formed in an integral manner disposed at its lower end, separately throughout the body or encompassing the entire periphery for different levels of buoyancy to be obtained so that if submerged into a container the straw will rise when uncapped to a desired level for use. Additionally the present invention has a bendable region for easier manipulation of the straws drinking end into one's mouth.

13 Claims, 10 Drawing Sheets

BUOYANT STRAW DEVICE

BACKGROUND OF THE INVENTION

1. Field of the Invention

The present invention relates generally to drinking straws and, more specifically, to a disposable drinking straw having a plurality of air bladders constructed to be integral with the internal throughbore of said straw in order to cause the straw to rise up and partially out of a fluid or sanitary container, such as a can or bottle, utilizing buoyancy of trapped air to make facilitation of an immersed buoyant straw more practical and easier to gain use thereof.

The straw of the present invention may be utilized on its own or packaged within a beverage container in order to rise out of the container when the container is opened.

Additionally the straw has a flexible portion for bending to an ideal location for use, along with its air bladders being constructed in a plurality of manners for increased or decreased buoyancy including a sole bottom air bladder, a plurality of air bladders and finally an air bladder extending the entire length of the inner periphery of the straw.

The present invention is composed of minimal material, no mechanical parts and in a thin small profile that can be produced in any length, shape, color or size utilizing preexisting manufacturing and packaging methods. Additionally the present invention can be utilized with any beverage or container and allows for enhancement of the marketing potential of any beverage by including the device inside of a sealed beverage or taped to the side of a beverage container.

2. Description of the Prior Art

There are other drinking devices designed for having buoyant properties. Typical of these is U.S. Pat. No. 942,306 issued to Clarke on Dec. 7, 1909.

Another patent was issued to Deanes on Jan. 15, 1918 as U.S. Pat. No. 1,253,579. Yet another U.S. Pat. No. 1,309,994 was issued to McAuliffe on Jul. 15, 1919 and still yet another was issued on Mar. 2, 1937 to Correl as U.S. Pat. No. 2,072,580.

Another patent was issued to Neuhauser on Jul. 30, 1963 as U.S. Pat. No. 3,099,565. Yet another U.S. Pat. No. 4,109,817 was issued to Payne et al. on Aug. 29, 1978. Another was issued to Turner Jr. et al on Mar. 29, 1988 as U.S. Pat. No. 4,733,785 and still yet another was issued on Oct. 31, 1989 to Larson et al. as U.S. Pat. No. 4,877,148.

Another patent was issued to Ahn on Nov. 3, 1992 as U.S. Pat. No. 5,160,058. Yet another U.S. Design Pat. No. D333,586 was issued to Cohen et al. on Mar. 2, 1993. Another was issued to Gul N. Lee on Oct. 19, 1993 as U.S. Pat. No. 5,253,779 and still yet another was issued on Jul. 11, 1995 to Rosello as U.S. Pat. No. 5,431,297.

Another patent was issued to Chein on Aug. 13, 1996 as U.S. Design Pat. No. D372,624. Yet another U.S. Pat. No. 5,547,103 was issued to Murphy et al. on Aug. 20, 1996. Another was issued to Cornell et al on Nov. 2, 1999 as U.S. Pat. No. 5,975,340 and still yet another was issued on Dec. 14, 1999 to Murphy et al. as U.S. Pat. No. 6,000,573

Another patent was issued to Lucas on Dec. 28, 1999 as U.S. Pat. No. 6,006,952. Yet another U.S. Pat. No. 6,142,326 was issued to Cornell et al on Nov. 7, 2000. Another was issued to Cornell et al on May 15, 2001 as U.S. Pat. No. 6,230,913 and still yet another was issued on Sep. 20, 2005 to Kim as U.S. Pat. No. 6,945,425.

Another patent was issued to Gaeng on Feb. 27, 1947 as British Patent No. GB621,455. Yet another PCT Patent No. WO9926861 was issued to Dunning on Jun. 3, 1999.

U.S. Pat. No. 942,306

Inventor: J. L. Clarke

Issued: Dec. 7, 1909

A drinking tube for a bottle or flask, provided with a resilient member and adapted to be confined within a bottle, and to be automatically projected at one end beyond the mouth of the bottle by said member when the bottle closure is removed.

U.S. Pat. No. 1,253,579

Inventor: S. A. Deanes

Issued: Jan. 15, 1918

A dispensing device substantially as herein described, comprising a bottle, a closure for the bottle, and a drinking tube fitted within the bottle and immersed, in part at least, in liquid contents thereof and having at or near its immersed end sleeve float fitted on the tube, as and for the purposes set forth, and an extension on the upper end of the tube.

U.S. Pat. No. 1,309,994

Inventor: J. W. McAuliffe

Issued: Jul. 15, 1919

The combination with a liquid container having a removable top, of a drinking tube device arranged within the container and adapted to have its upper end raised out of the container when the latter is opened, and a stop device for limiting the upward movement of the device.

U.S. Pat. No. 2,072,580

Inventor: H. N. Correll

Issued: Mar. 2, 1937

A mounted drinking tube comprising a nitrocellulose, a filler such a ground wood, and castor oil, and including sufficient gas cells to render the tube buoyant when immersed in a liquid.

U.S. Pat. No. 3,099,565

Inventor: R. L. Neuhauser

Issued: Jul. 30, 1963

A drinking straw for use in containers for effervescent and carbonated beverages comprising an elongated hollow straw member, a bell-shaped element attached to said straw member, said bell-shaped element extending radially outward and downwardly from said straw member and disposed near the bottom end thereof to be immersed within the beverage for capturing a portion of gases liberated from the beverage to thereby effectively raise said straw member into a drinking position.

U.S. Pat. No. 4,109,817

Inventor: Larry E. Payne et al.

Issued: Aug. 29, 1978

A straw assembly for a liquid container having a pull-tab closure over an opening in its top. Removal of the closure allows the straw which is collapsed within the container and has a float mounted on its bottom end, to rise through the opening where it is manually extended to its full length. One embodiment includes the straw being slidably journaled within a tube mounted on the inner wall of the container. Another embodiment includes a straw guide assembly which positions the straw within the container in registry with an opening centrally disposed through the container top.

U.S. Pat. No. 4,733,785

Inventor: Dan B. Turner Jr. et al.

Issued: Mar. 29, 1988

The present disclosure is directed to a beverage container having a tapered neck portion smaller than a buoyant chamber on the container advertising straw having a flexible straw the overall length of which fits from the inside of the container bottom to the inside of the container cap when the cap is seated on the container top. A mini-buoyant chamber in the geometric form of the container in which it is to be placed is on the exterior of the straw. The mini-chamber has an external diameter such as to catch against the inner neck of the beverage container to prohibit accidental separation of the straw from the bottle, but which permits removal of the straw and mini-container from the beverage container by a firm pull, which due to the constriction of the neck, will compress the mini-container from the bottle. An advertising message is on the exterior of the mini-container containing the logo of the bottler which will remain with the straw and mini-buoyant after its disassociation from the bottle.

U.S. Pat. No. 4,877,148

Inventor: Gordon Larson et al.

Issued: Oct. 31, 1989

A straw assembly is provided for a liquid container having a push tab or pull tab closure in a metallic container or a screw type closure on a plastic container. The straw is retained within the container in a retracted position even following opening of the removable closure. The straw is moved to an operative position by depressing a portion of the container so as to shift the straw laterally and permit the straw to emerge through the dispensing opening by means of a buoyancy collar on the straw.

U.S. Pat. No. 5,160,058

Inventor: Si Y. Ahn

Issued: Nov. 3, 1992

A drinking straw contained in a bottle having a flexible portion (3), a floating ball (2), a ring (4), and a washer (5). When the cap is opened, the straw comes up immediately to an ideal drinking position and the user does not have to use his/her fingers to hold it. This convenient and safe way of drinking beverages will make any drinking experience a pleasurable one.

U.S. Pat. No. Des. 333,586

Inventor: Jacob Cohen et al.

Issued: Mar. 2, 1993

This United States patent discloses an ornamental design for a drinking straw as illustrated in the drawings of the patent.

U.S. Pat. No. 5,253,779

Inventor: Gul N. Lee

Issued: Oct. 19, 1993

A beverage container having a sloping upper wall and enclosing a self-contained pop-up straw assembly. The straw assembly has telescopic inner and outer tubes and resilient means urging the tubes against the sloping container wall, causing the straw assembly to center itself and pop-up when the container is opened.

U.S. Pat. No. 5,431,297

Inventor: Agustin A. Rosello

Issued: Jul. 11, 1995

A pop-up straw device for containers such as cans and bottles having necks narrower than the body of the bottle. When the device is employed in a can, a vertical guide assembly aligns a telescoping straw assembly with a beverage container's mouth. The telescoping straw assembly includes interior and exterior straws. The interior straw extends out of the mouth of the beverage container once the container is opened. A floater, having a density less than that of the liquid in the container, urges the telescoping straw assembly to protrude out of the container's mouth. In an alternative embodiment, a bracket assembly is mounted to the interior top of the can and aligns the telescoping straw assembly with the mouth of the can. When the device is utilized in a bottle only the floater and the telescoping straw assemblies are required. The walls of the body and neck of the bottle, in conjunction with the floater align the telescoping straw assembly with the mouth of the bottle and the floater is of sufficient rigidity such that it cannot be easily pulled through the mouth of the bottle and thereby prevents the telescoping straw assembly from being pulled completely out of the bottle while at the same time permitting a user to extend the telescoping straw assembly partially out of the bottle.

U.S. Pat. No. Des. 372,624

Inventor: Adam Chein

Issued: Aug. 13, 1996

This United States patent discloses an ornamental design for a drinking straw as illustrated in the drawings of the patent.

U.S. Pat. No. 5,547,103

Inventor: Peter E. Murphy

Issued: Aug. 20, 1996

A beverage container having a straw-dispensing mechanism that is disposed within the container and is responsive to appropriate manipulation of the container to bring the straw into alignment with the orifice in the top end of the container. The straw is supported by a weighted member that responds to the manipulation of the container to move the straw. A float is attached to the straw to elevate the straw through the orifice when the straw is aligned with the orifice. Several alternative embodiments of the invention are disclosed.

U.S. Pat. No. 5,975,340

Inventor: Stephen W. Cornell et al.

Issued: Nov. 2, 1999

A straw assembly disposed within a beverage container and adapted for use with various positioning mechanisms is disclosed. The straw assembly includes a plurality of structural features formed therein for appropriately locating the positioning mechanism. Additionally, a positioning mechanism slidably locatable along the axial length of the straw is disclosed which appropriately positions the straw in an opening of the container. The straw assembly may be fabricated from a photo-degradable material which expedites the photodegradation of the straw assembly when exposed to sunlight.

U.S. Pat. No. 6,000,573

Inventor: Peter E. Murphy et al.

Issued: Dec. 14, 1999

A beverage container has a straw-dispensing mechanism that is disposed within the container to bring the straw into alignment with the orifice in the top of the container. When the orifice is opened, the straw elevates through the orifice to become accessible to the user. In one embodiment, the straw is attached to a buoyant member which urges the straw into contact with a contoured surface on the can lid. In a second embodiment, the straw engages a floating member which is urged against the lid of the container. In a third embodiment, a buoyant member is integrally formed with the straw and is disposed orthogonally within the body of the can. In a fourth embodiment, the floating member includes a surface treated for facilitating the nucleation of CO.sub.2 thereon. In a fifth embodiment, the floating member is provided with a skirt for entrapping a head space gas bubble under the floating member. In a sixth embodiment, the floating member reacts to a change in pressure to disengage from the container wall. In a seventh embodiment, a latch is provided on the floating member for releasing the floating member from engagement with the container walls. In an eighth embodiment, the floating member is provided with a threaded aperture for releasably engaging a threaded member on the bottom of the container. In a ninth embodiment, a straw positioning member is provided with an inertia latch which opens to increase the diameter of the straw positioning member such that it engages the container wall.

U.S. Pat. No. 6,006,952

Inventor: Monty J. Lucas

Issued: Dec. 28, 1999

A sports bottle with contoured finger grooves for a better grip, a series of folds for preventing deformation of the bottle when squeezed by absorbing compressive forces, having a lid defining one-way air inflow orifices separate from a liquid outflow orifice, an integral straw member for directing liquids from within the bottle by either sucking or squeezing to the liquid outflow orifice, and a cap slidably attached to the straw member such that the liquid outflow orifice and the air inflow orifices are sealed when the cap is in the down position. The bottle allows the consumption of a liquid without tipping the bottle or interrupting consumption, and is adapted to open and close using only one hand.

U.S. Pat. No. 6,142,326

Inventor: Stephen W. Cornell

Issued: Nov. 7, 2000

A container includes a body defining a chamber having a neck region and a straw disposed within the chamber. The straw is inserted through the neck region and into the chamber prior to filling the chamber and is trapped or wedged between the bottom of the container and an annular ridge defined by the neck region of the chamber. When filling has been completed, the body is manipulated to release the straw from the annular ridge and position it within the neck region.

U.S. Pat. No. 6,230,913

Inventor: Stephen W. Cornell

Issued: May 15, 2001

A container includes a body defining a chamber and a neck region. A straw is disposed within the chamber. The straw is inserted through the neck region and into the chamber prior to filling the chamber and is trapped or wedged between a first portion of the container and a second portion of the container by mechanical engagement with the container. The position of the straw within the chamber does not interfere with the filling of the container. When filling has been completed, the body of the container is manipulated to release the straw from its mechanical engagement with the container and position it within the neck region.

U.S. Pat. No. 6,945,425

Inventor: Sung Suk Kim

Issued: Sep. 20, 2005

An internal to external self-buoyant straw system for the safe and sanitary removal of contents from aluminum can lift tab containers. The system includes a top straw component (14) cylindrical and hollow in fabrication which vertically slides within close tolerance over its hollow bottom straw component (16) whose lower end is angular cut (30) and held in continuous contact with the container's inner bottom. The top straw component continues its vertical ascent until its integrally fabricated buoyancy float (15) makes contact with the guidance ring (13) which keeps the top straw component directly positioned inline with the container's lid opening. The upper straw component (23) having reached drinking access level may now be angularly adjusted at the outer segmented straw portion (22) for ease of consumption of contents through the rolled lip end (28). Stability and appropriate positioning of the internal to external self-buoyant straw system within its container is accomplished by means of an articulated structure: holding frame (19) and holding frame arm (29) anchored to the underside of the container's lid at points (24A) and (24B) with the holding frame's lowermost end connected at point (18) to the bottom straw component, thusly causing the bottom straw component to remain stationary and in continuous contact with the container's innermost bottom. The all aluminum fabrication of the internal to external self-buoyant straw system allows for recycling within the aluminum can lift tab beverage container.

British Patent Number GB621455

Inventor: Monty J. Lucas

Issued: Feb. 27, 1947

A drinking "straw" 4 is fitted with a cork or other float 5 or a hollow ball so that the drinking end is automatically ejected out of the beverage container 1 when the stopper is removed. A guiding collar may be provided on the container, and a flexible rubber tube 9 at the bottom of the "straw."

International Patent Application Number WO9926861

Inventor: Charles E. Dunning

Issued: Jun. 3, 1999

A beverage container (10) has an extendable straw (22) inside for a convenient and sanitary drinking purpose. Preferably, the beverage container (10) is equipped with a top (13) having a raised portion (15). A float (28) is positioned on the straw (22) to elevate it against a top (13) of the container. The float (28) is substantially larger than the openable portion (18) to retain the lower end (26) of the straw (22) in the container (10) while the upper end (24) is extended through the openable portion (18) for use. Preferably, a fixing means (30) fixes the straw temporarily to the container (10) at the time of filling and hermetically closing the container with the top (13), and releases the straw (22) automatically to allow flotation within the container (10) after closing the container (10). The beverage container with the pop-up straw (22) facilitates sanitary drinking and is compatible with high-speed canning.

While these straws may be suitable for the purposes for which they were designed, they would not be as suitable for the purposes of the present invention, as hereinafter described.

SUMMARY OF THE PRESENT INVENTION

The present invention provides a straw which typically is a tube with a single wall that may incorporate a series of circumferential folds for angularly deflecting a portion of the straw and strategically placed air pockets forming an integral part of the straw so that when placed in a liquid the air pockets will prevent the straw from sinking to the bottom of the container that it is used in.

The method of providing the buoyant straw of the instant invention considers the viscosity of the liquid that the straw will be used in and when required the desired angle of deployment from a sealed container when opened.

A primary object of the present invention is to provide a buoyant straw having sealed air pockets of bladders of air integrated into the inner periphery to cause the straw to rise a predetermined distance when placed in a liquid.

Another object of the present invention is to provide a buoyant straw having bladders of air integrated into the inner periphery so that if submerged and sealed within a liquid container, the straw will rise to a level more assessable to the user.

Yet another object of the present invention is to provide a buoyant straw having spaced apart bladders of air disposed therein having at least two bladders located on opposing sides situated in such a manner as to provide a substantially vertical rise of the straw when deployed.

Still yet another object of the present invention is to provide a buoyant straw having a plurality of air bladders positioned to effect a desired angle of deployment.

A further object of the present invention is to provide a buoyant straw incorporating an interior layer of similar straw material that is conjoined with the interior straw wall constructed to form at least two air filled cavities positioned on opposing interior wall surfaces.

A yet further object of the present invention is to provide a buoyant straw with sealed interior air pockets of variable size depending on the length of the straw; the liquid properties, e.g. viscosity, carbonated, sweetened that the straw will be used with; the weight of the straw and the desired distance to extend the straw above the rim of the container.

An optional object of the present invention is to provide a buoyant straw having a series of circumferential folds for angularly deflecting a portion of the straw.

A still yet further object of the present invention is to provide a buoyant straw that after use is disposable.

An additional object of the present invention is to provide a buoyant straw that does not rely on the user to manipulate the container after it has been opened to align the buoyant straw with the opening.

Another object of the present invention is to provide a buoyant straw manufactured in endless number of lengths and colors.

Yet another object of the present invention is to provide a buoyant straw that is structurally simple and inexpensive to mold.

Still yet another object of the present invention is to provide a buoyant straw that is relatively thin and small enabling minimal shipping and storage space.

A further object of the present invention is to provide a buoyant straw that uses minimal material.

A yet further object of the present invention is to provide a buoyant straw that can be adjusted to accommodate different lengths.

A still yet further object of the present invention is to provide a buoyant straw that is hygienic and sanitary by virtue of its enclosure within a sealed drink container.

Another object of the present invention is to provide a buoyant straw providing beverage marketers with a point of differentiation.

Yet another object of the present invention is to provide a buoyant straw having no mechanical parts.

Still yet another object of the present invention is to provide a buoyant straw that can be used with a variety of beverages that have different viscosity properties including sports drinks, effervescent (carbonated) beverages, water, juices and milk.

A further object of the present invention is to provide a buoyant straw that can be used in a variety of containers including cans, bottles and boxes.

A yet further object of the present invention is to provide a buoyant straw that can be used with various container shapes and beverages.

A still yet further object of the present invention is to provide a buoyant straw having the same packaging and shipping costs to distributors, retailers and end users.

Another object of the present invention is to provide a buoyant straw using existing manufacturing facilities with minimal alteration to manufacture.

Yet another object of the present invention is to provide a buoyant straw that can be taped to the sides of cans or inserted into containers at processing facilities.

Still yet another object of the present invention is to provide a buoyant straw that is simple to market by virtue of the product being extremely recognizable having substantially similar outside dimensions, look and feel of the typical drinking straw.

A further object of the present invention is to provide a buoyant straw that is highly usable in different beverage industries.

A yet further object of the present invention is to provide a buoyant straw that can be wrapped by paper or clear plastic like all other straws or left without a wrapping.

Additional objects of the present invention will appear as the description proceeds.

The present invention overcomes the shortcomings of the prior art by providing a drinking straw having bladders of air formed in an integral manner disposed at its lower end, separately throughout the body or encompassing the entire periphery for different levels of buoyancy to be obtained so that if submerged into a container the straw will rise when uncapped to a desired level for use. Additionally the present invention has a bendable region for easier manipulation of the straws drinking end into one's mouth.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
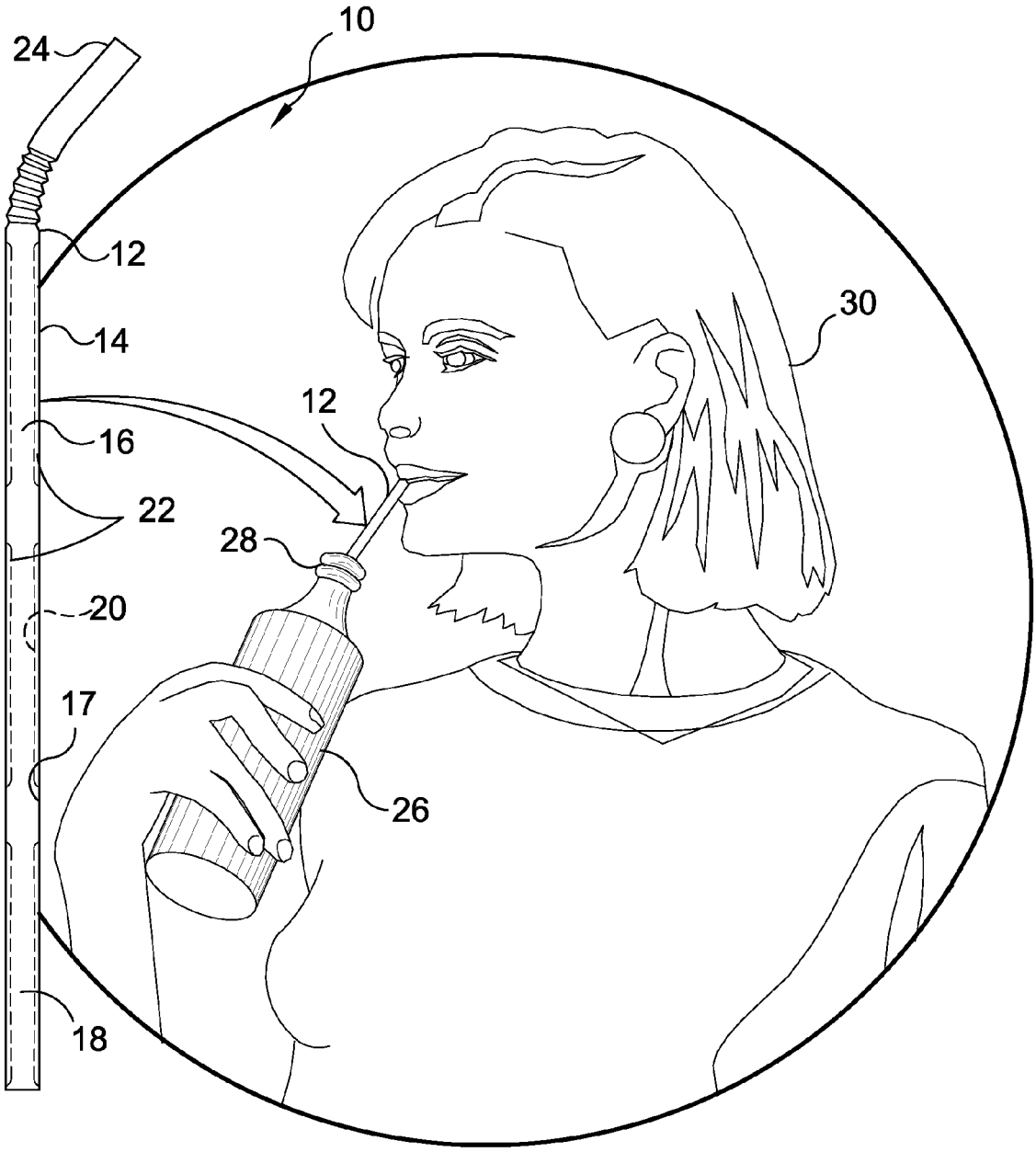
FIG. 1 is an illustrative view of the present invention in use.

Turning now descriptively to the drawings, in which similar reference characters denote similar elements throughout the several views, the figures illustrate the Buoyant Straw Device with Internal Air Bladders of the present invention. With regard to the reference numerals used, the following numbering is used throughout the various drawing figures.

10 Buoyant Straw Device with Internal Air Bladders of the present invention
12 straw
14 outer wall of 12
16 interior portion of 12
17 interior wall of 12
18 fluid passageway
20 bladder wall
22 sealed air bladder
24 top portion of 12
26 beverage container
28 mouth of 26
30 user
32 base of 12
34 flex section of 34
36 divider wall
38 fluid
40 cap of 26
42 air
44 fluid surface
46 intersecting wall
48 air bladder seal

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a buoyant straw 12 comprising an outer straw wall 14 with an interior portion 16 having an interior wall 17 with at least one central through bore forming a fluid passageway 18 extending therethrough. At least one spaced-apart wall 20 is bonded to the interior wall 17 and creates a sealed air bladder 22 of appropriate size to propel the top straw portion 24 above the mouth 28 of the beverage container 26 to provide better access for the user 30. The buoyant straw 12 having a plurality of longitudinal air bladders 22 providing access to the straw 12 once opened. The buoyant straw having a straw interior air bladder 22 extending the length of the straw 12.

Figure 2:
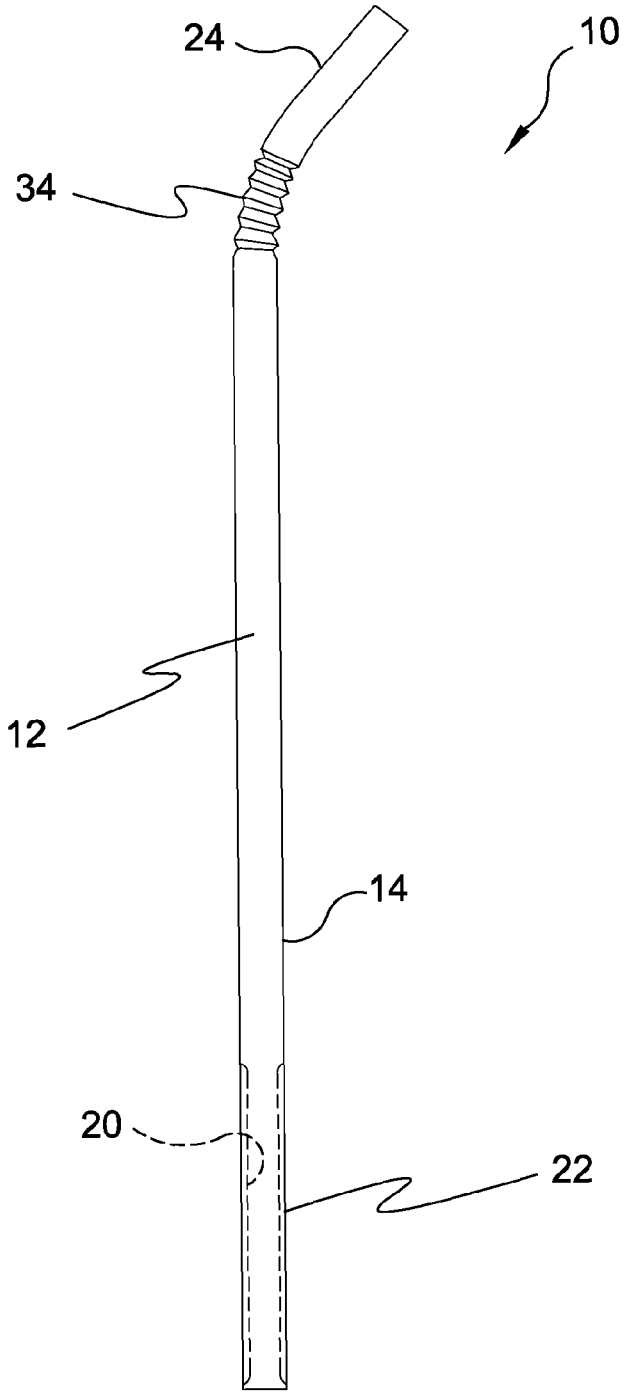
FIG. 2 is a sectional view of the present invention.

FIG. 2 is a sectional view of the present invention 10. Shown is a sectional view of the straw 12 buoyant straw comprising an outer straw wall 14 with an interiorly positioned bladder wall 20 of a smaller diameter that when sealed creates an air bladder 22 of appropriate size to propel the top straw portion 24 above the mouth of the beverage container when opened. This buoyant straw 12 having air bladders 22 located at the base 32 of the straw 12. Further included is an accordion-like, resilient, bendable flex section 34 that enables the user to selectively reposition the angular orientation of the top portion 24 of the straw 12.

Figure 3:
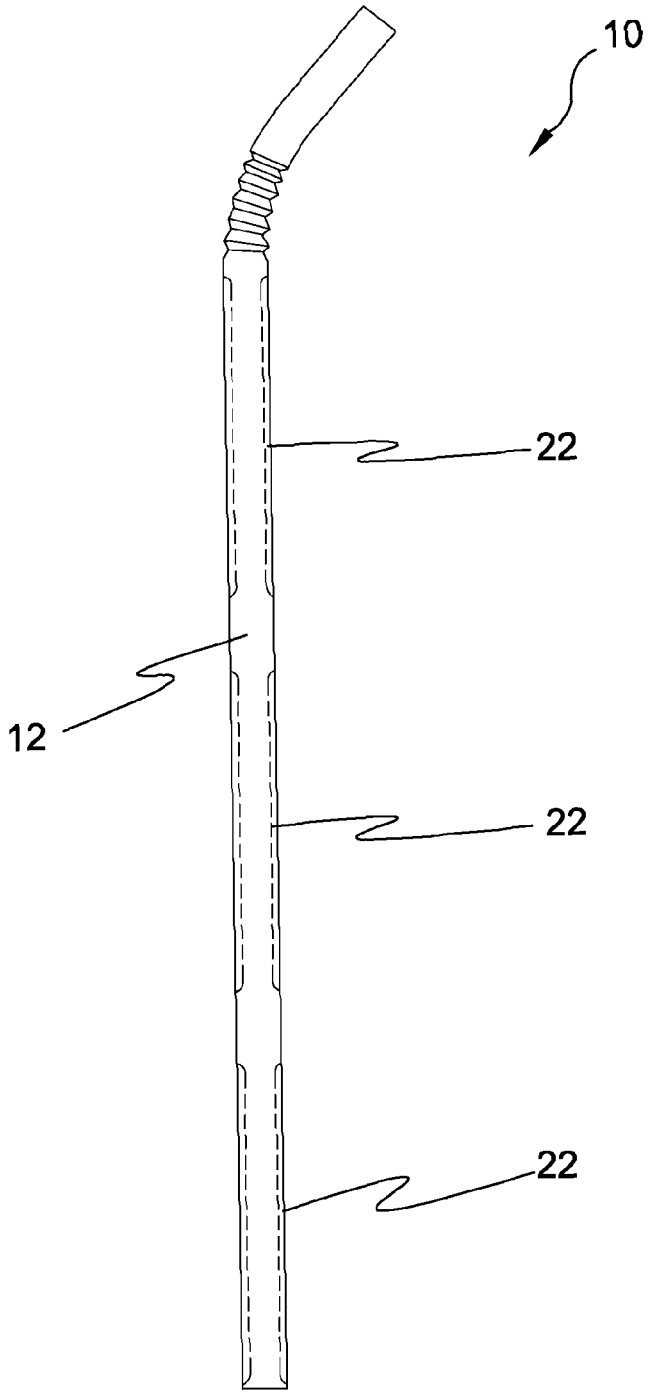
FIG. 3 is a sectional view of the present invention.

FIG. 3 is a sectional view of the present invention 10. Shown is the straw 12 having a plurality of longitudinally spaced apart air bladders 22.

Figure 4:
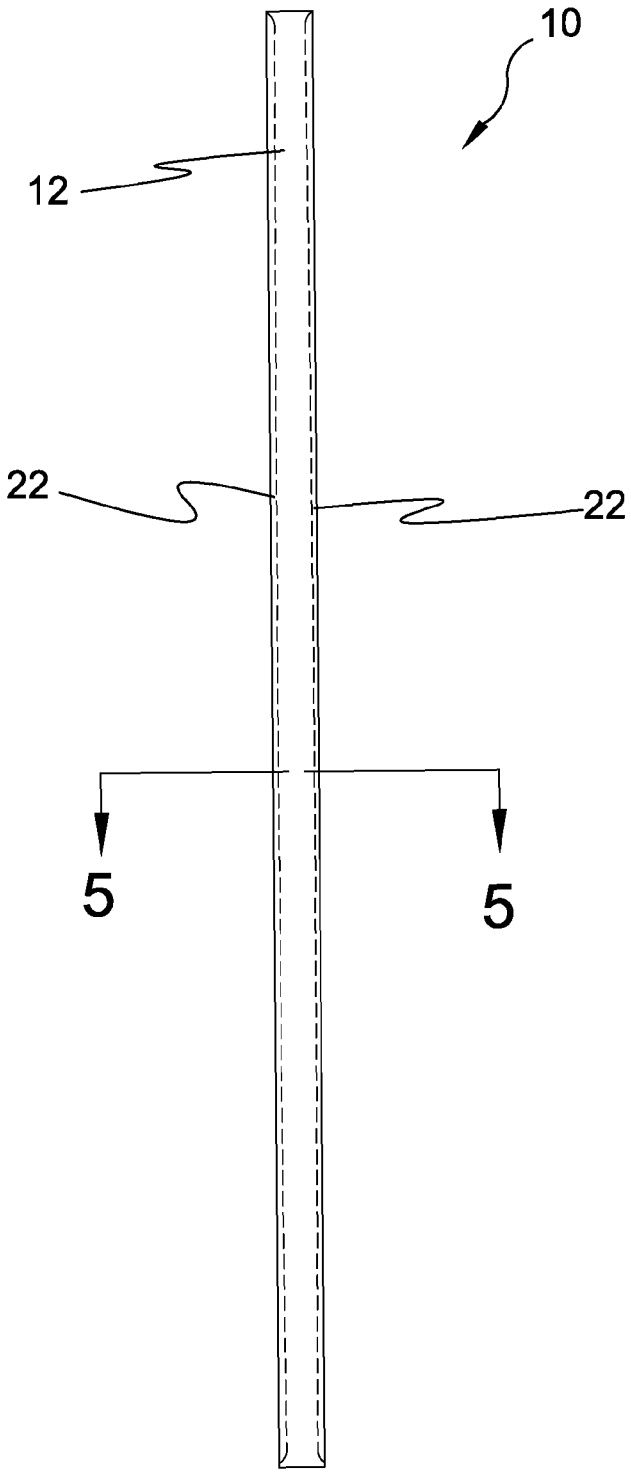
FIG. 4 is a sectional view of the present invention.

FIG. 4 is a sectional view of the present invention 10. Shown is the straw 12 having a plurality of air bladders 22 extending the length thereof.

Figure 5:
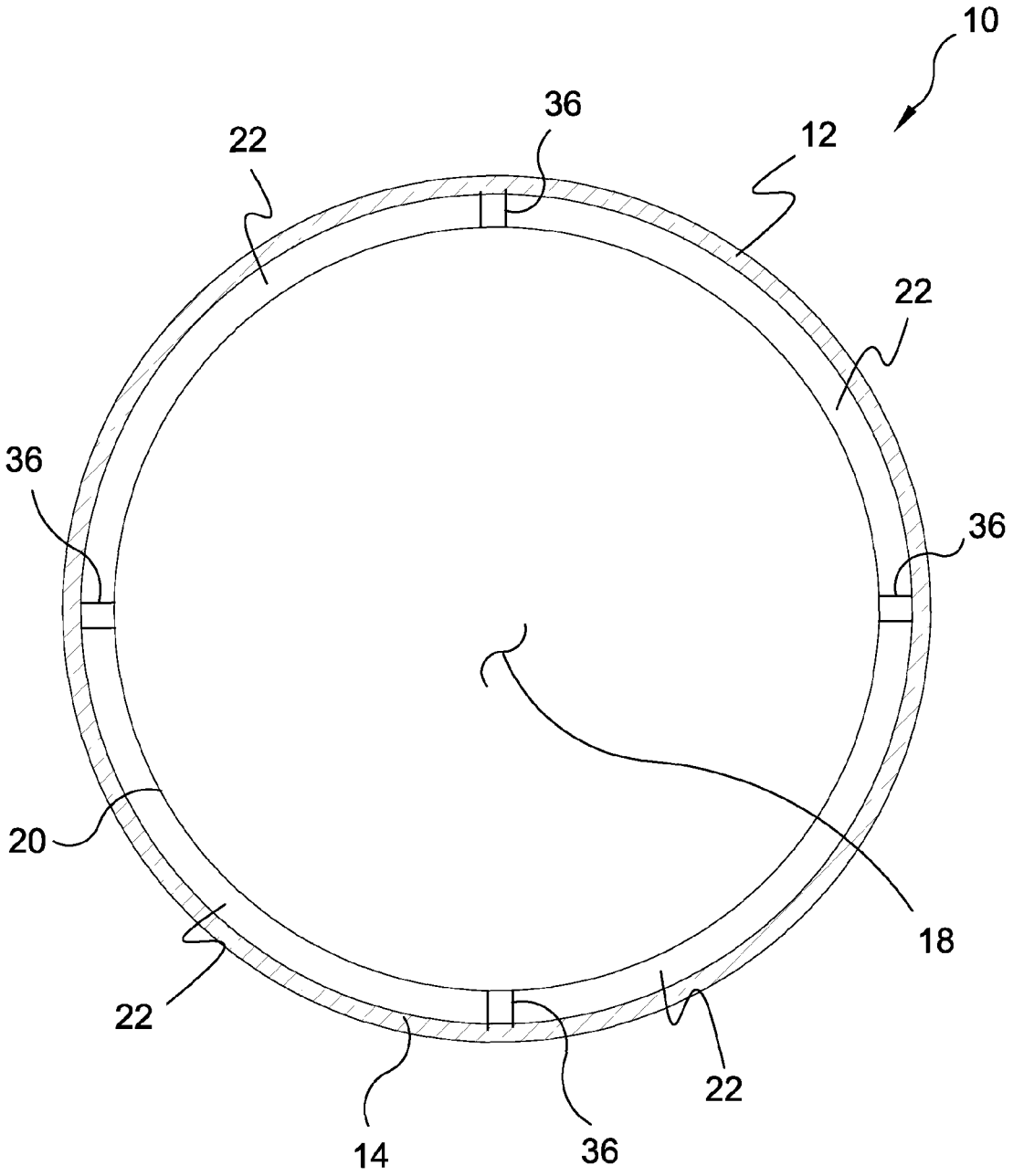
FIG. 5 is a cross sectional view of the present invention.

FIG. 5 is a cross sectional view of the present invention 10 taken from FIG. 4 as indicated. Shown is the straw 12 having an outer wall 14 having a plurality of divider walls 36 communicating with the bladder wall 20 thereby creating a plurality of air bladders 22 therein that surround the fluid passageway 18.

Figure 6:
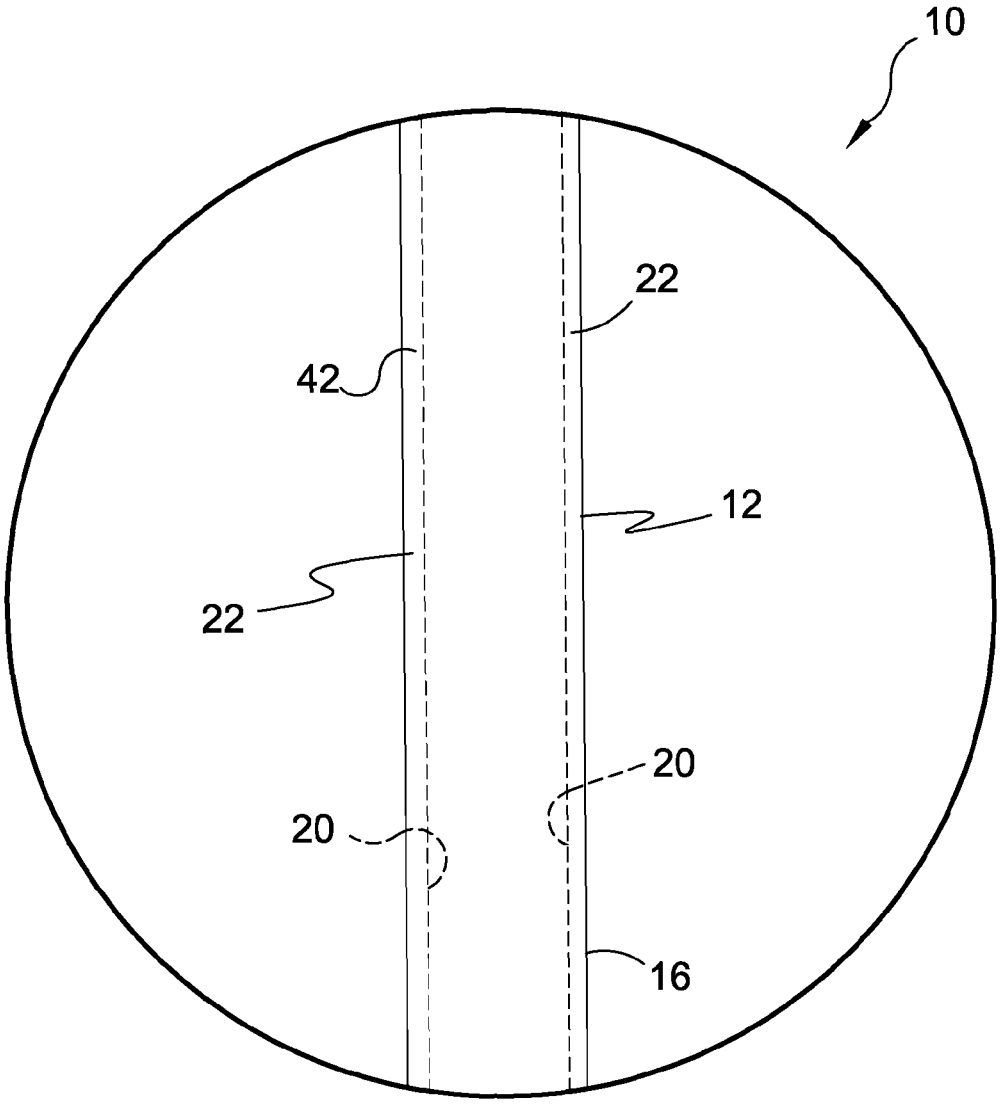
FIG. 6 is a detailed view of the present invention.

FIG. 6 is a detailed view of the present invention 10. Shown is the straw 12 having air bladders 22 defined by the outer wall 14 and the bladder wall 20. The air 42 trapped within the air bladders 22 provides the buoyancy to elevate and suspend the straw 12.

Figure 7:
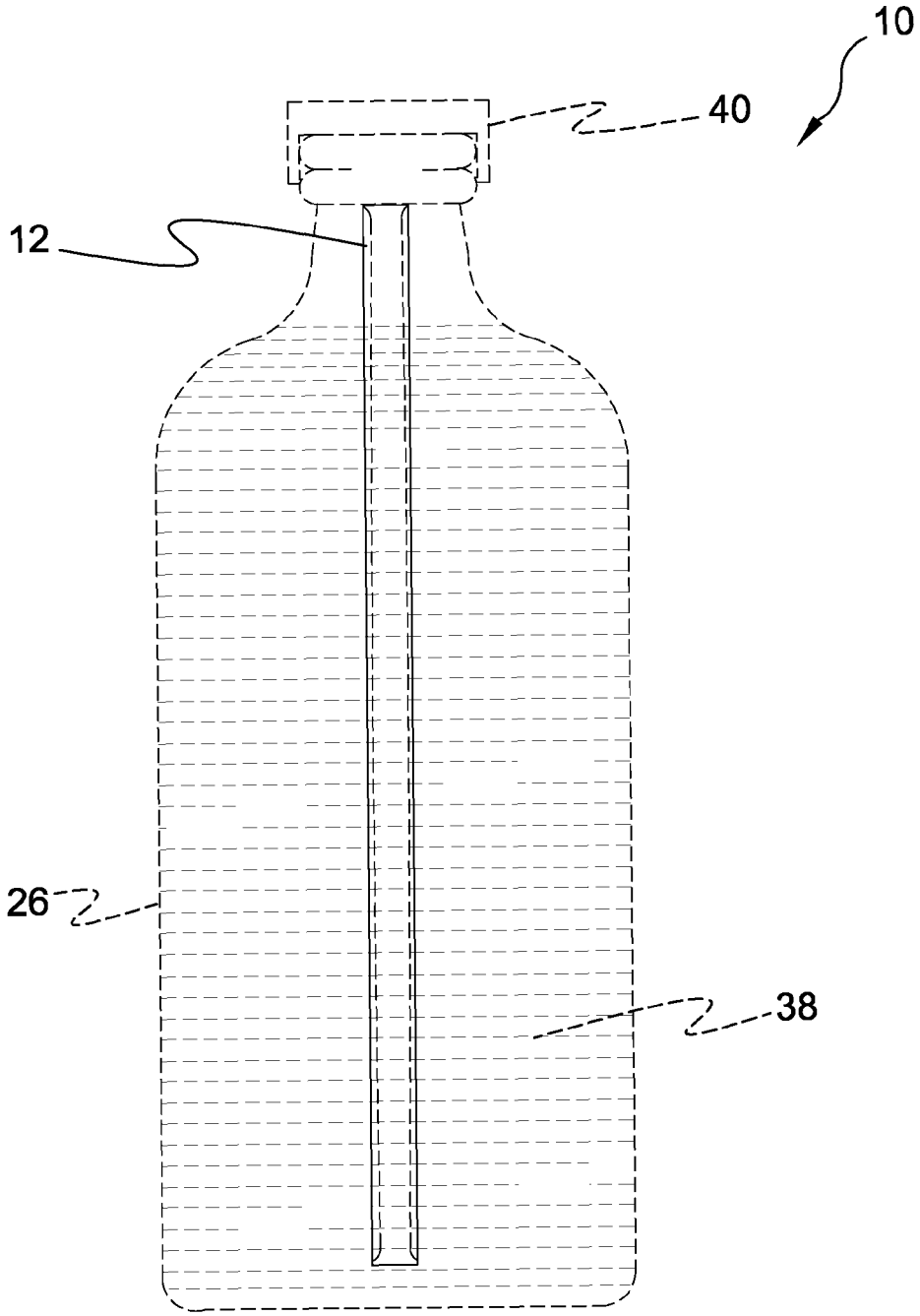
FIG. 7 is a side sectional illustration of the present invention.

FIG. 7 is a side sectional illustration of the present invention 10. Depicted is the straw 12 in the fluid 38 of a closed beverage container 26 and retained from elevating further by the container cap 40.

Figure 8:
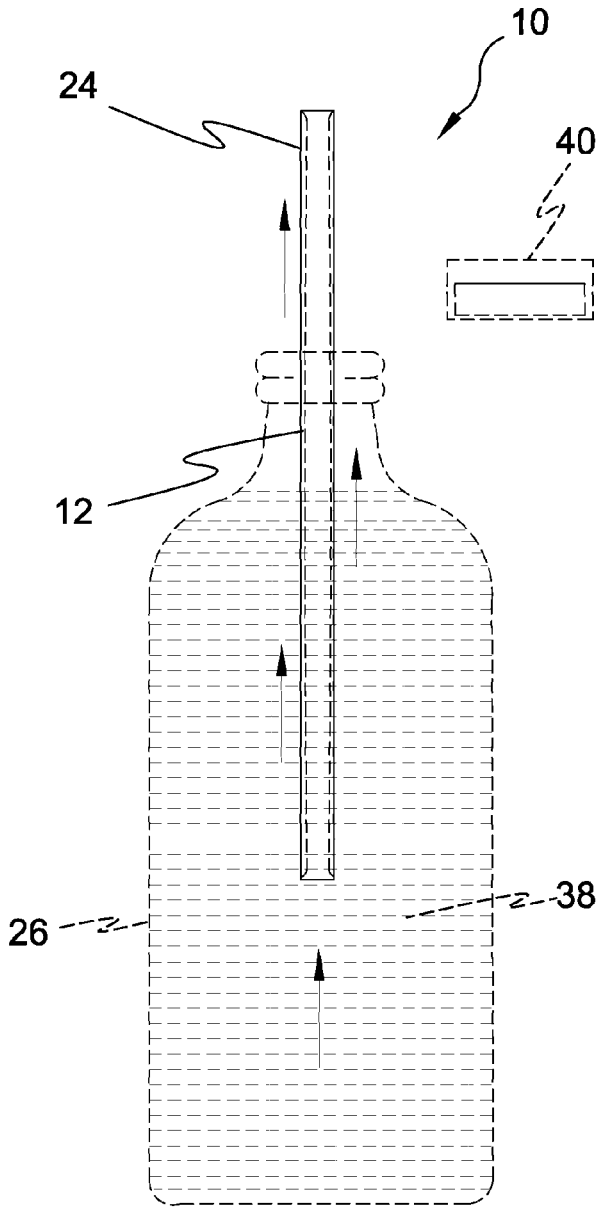
FIG. 8 is a side sectional illustration of the present invention.

FIG. 8 is a side sectional illustration of the present invention 10. Illustrated is the cap 40 removed from the beverage container 26 thereby releasing the straw 12 in the fluid 38 to elevate and remain suspended above the fluid surface 44 providing access to the top portion 24 thereof to the user.

Figure 9:
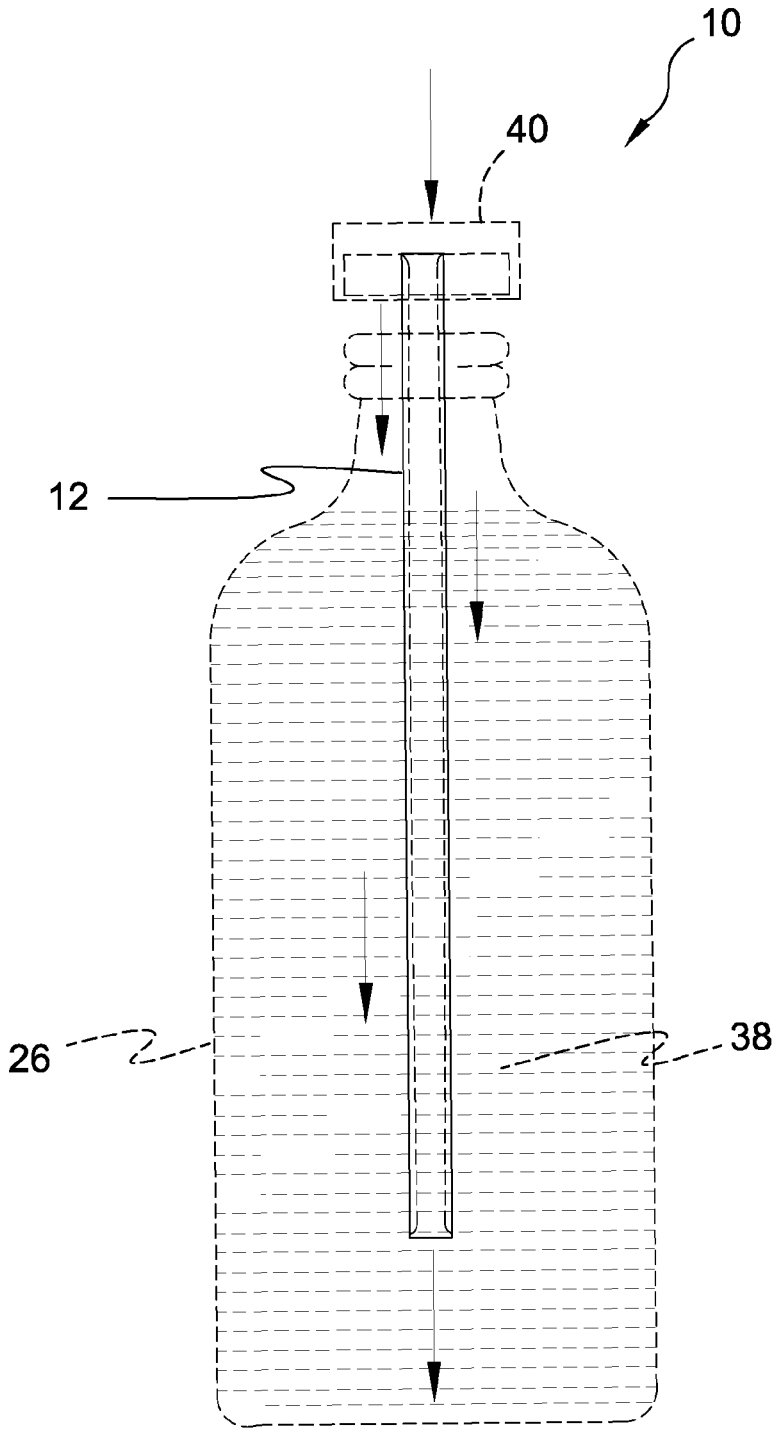
FIG. 9 is a side sectional illustration of the present invention.

FIG. 9 is a side sectional illustration of the present invention 10. Shown is the cap 40 being replaced on the container 26 and urging the straw 12 downward back into the fluid 38.

Figure 10:
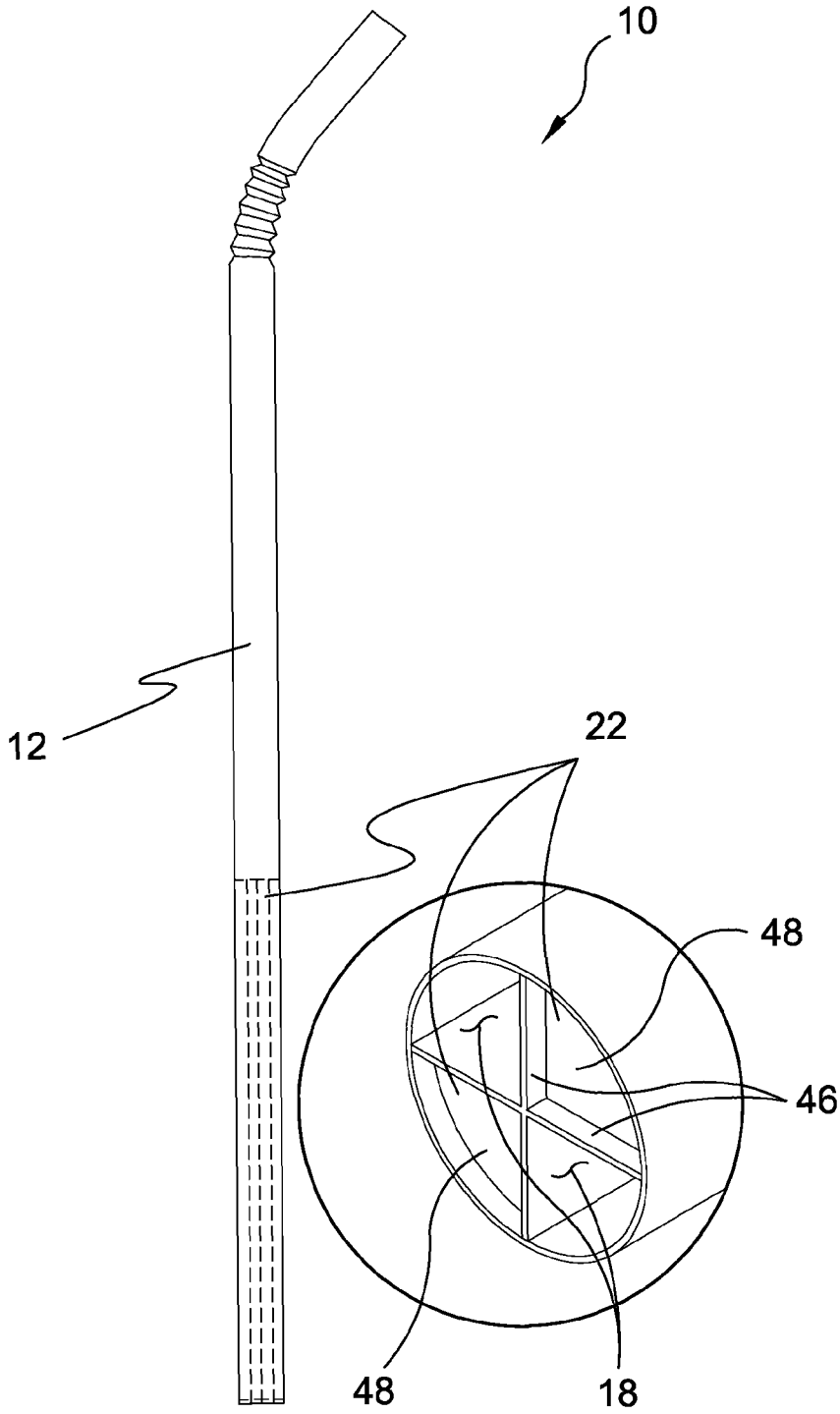
FIG. 10 is a sectional view of the present invention.

FIG. 10 is a sectional view of the present invention 10. Shown is the present invention having its lower base portion 32 split into four sections by intersecting walls 46 and having two opposing sections with seals 48 at its top and bottom to form air bladders 22. The alternately adjacent channels define the fluid passageways 18. Additionally the size of the air bladders 22 and general buoyancy of the straw can be easily changed in accordance to the degree at which the boundaries that form the four sections cross at and which sections are sealed.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A buoyant drinking straw device for elevating and suspending said straw in a fluid comprising:

a) a tubular straw having a top portion, a base portion, an exterior outer wall surface and an interior wall surface;

b) at least one fluid passageway extending longitudinally through said straw;

c) wherein a top portion of said straw further comprises a flexible section to enable the user to adjust the angular displacement of the top of said straw to facilitate the use thereof;

d) a plurality of air bladders disposed within said straw to provide buoyancy thereto, said air bladders being disposed longitudinally in spaced apart relation on said interior wall of said straw below said flexible section; and e) wherein each said air bladder comprises a sealed bladder wall bonded to said interior wall of said straw and containing trapped air therein as the buoyancy element.

2. The buoyant drinking straw device recited in claim 1, wherein said opposing air bladders extend longitudinally along the entire length of said interior wall of said straw.

3. The buoyant drinking straw device recited in claim 2, wherein said air bladders share a common bladder wall that is in spaced apart concentric relation with said interior wall of said straw.

4. The buoyant drinking straw device recited in claim 1, wherein a portion of said straw interior is subdivided into four separate sections by intersecting walls.

5. The buoyant drinking straw device recited in claim 4, wherein said intersecting walls subdivide the interior portion into fluid passageways and air bladders that are sealed to trap air therein.

6. The buoyant drinking straw device recited in claim 5, wherein the adjacent subdivided sections alternate between air bladders and fluid passageways.

7. The buoyant drinking straw device recited in claim 1, wherein the size and placement of said air bladders are determined by variables selected from the group of:

a) the length of the straw;

b) the liquid properties, e.g. viscosity of the fluid;

c) carbonation and sweeteners in the fluid that the straw will be used with;

d) the weight of the straw; and e) the desired distance to extend the straw above the rim of the container.

8. The buoyant drinking straw device recited in claim 1, wherein the top portion of said straw further comprises a flexible section to enable the user to adjust the angular displacement of the top of said straw to facilitate the use thereof.

9. The buoyant drinking straw device recited in claim 1, wherein said straw is disposed within a commercial beverage container during the bottling process.

10. The buoyant drinking straw device recited in claim 9, wherein said straw is released, elevated and suspended above the rim of said container upon removal of the cap therefrom.

11. The buoyant drinking straw device recited in claim 1, wherein said straw is provided in a hermetically sealed plastic wrapper.

12. The buoyant drinking straw device recited in claim 11, wherein said wrapped straw is taped to the associated beverage container during manufacture.

13. The buoyant drinking straw device recited in claim 11, wherein said wrapped straw is provide individually for use with any beverage container.

* * * * *